US008506272B2

(12) United States Patent
Fan et al.

(10) Patent No.: US 8,506,272 B2
(45) Date of Patent: Aug. 13, 2013

(54) SCROLL COMPRESSOR LUBRICATION SYSTEM

(75) Inventors: Shuichong Fan, Suzhou (CN); Linzhi Chao, Suzhou (CN); Yu Fei, Suzhou (CN)

(73) Assignee: Emerson Climate Technologies (Suzhou) Research & Development Co., Ltd., Jiangsu (CN)

( * ) Notice: Subject to any disclaimer, the term of this patent is extended or adjusted under 35 U.S.C. 154(b) by 344 days.

(21) Appl. No.: 12/891,157

(22) Filed: Sep. 27, 2010

(65) Prior Publication Data

US 2011/0085925 A1 Apr. 14, 2011

Related U.S. Application Data

(60) Provisional application No. 61/250,723, filed on Oct. 12, 2009.

(51) Int. Cl.
*F04C 29/02* (2006.01)

(52) U.S. Cl.
USPC ..... 418/88; 418/94; 418/102; 417/410.5

(58) Field of Classification Search
USPC ..... 417/228, 372, 410.5, 423.13, 902; 418/88, 94, 102; 184/6.16
See application file for complete search history.

(56) References Cited

U.S. PATENT DOCUMENTS

| | | | | |
|---|---|---|---|---|
| 4,623,306 | A * | 11/1986 | Nakamura et al. | 418/55.6 |
| 5,110,268 | A * | 5/1992 | Sakurai et al. | 417/410.5 |
| 5,580,233 | A * | 12/1996 | Wakana et al. | 418/94 |
| 6,682,322 | B2 * | 1/2004 | Funakoshi et al. | 417/410.5 |
| 6,896,496 | B2 * | 5/2005 | Haller et al. | 418/55.1 |
| 7,566,210 | B2 * | 7/2009 | Elson et al. | 418/55.6 |

* cited by examiner

*Primary Examiner* — Charles Freay
*Assistant Examiner* — Charles W Nichols
(74) *Attorney, Agent, or Firm* — Harness, Dickey & Pierce, P.L.C.

(57) ABSTRACT

A lubricant metering system for a compressor may include a cap, a cap cage, and a shaft. The cap may include an outer surface, a first recess, and a first radial bore extending between the first recess and the outer surface. The cap cage may include a second recess receiving the cap and a lubricant inlet in communication with the first recess via the first radial bore. The shaft may be received within the first recess and may include an axially extending bore and a second radial bore extending between an outer diameter of the shaft and the axially extending bore. The shaft may be mounted for rotation relative to the cap to allow lubricant to flow into the axially extending bore via the first and second radial bores when the second radial bore is aligned with the first radial bore.

28 Claims, 5 Drawing Sheets

SCROLL COMPRESSOR LUBRICATION SYSTEM

CROSS-REFERENCE TO RELATED APPLICATIONS

This application claims the benefit of U.S. Provisional Application No. 61/250,723, filed on Oct. 12, 2009. The entire disclosure of the above application is incorporated herein by reference.

FIELD

The present disclosure relates to a compressor, and more particularly to a lubrication system for a compressor.

BACKGROUND

This section provides background information related to the present disclosure which is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. The compressor may be one of any number of different compressors. For example, the compressor may be a scroll compressor or a reciprocating compressor that selectively circulates the working fluid among the various components of a cooling, refrigeration, or heat-pump system. Regardless of the particular type of compressor employed, consistent and reliable operation of the compressor is required to ensure that the cooling, refrigeration, or heat-pump system in which the compressor is installed is capable of consistently and reliably providing a cooling and/or heating effect on demand.

Compressors typically include a hermetic or semi-hermetic shell. A partition disposed within the shell divides the shell into a suction-pressure zone and a discharge-pressure zone. The working fluid is drawn into the suction-pressure zone and compressed by a compression mechanism and discharged therefrom into the discharge-pressure zone.

A lubricant sump may be disposed within the shell and stores a volume of lubricant, such as oil, for example. The lubricant serves to lubricate the moving components of the compressor and can flow with the working fluid through the compression mechanism and into the discharge-pressure zone of the compressor. The temperature of the lubricant and working fluid in the discharge-pressure zone is elevated relative to the lubricant and working fluid in the suction-pressure zone.

In the discharge-pressure zone, some or all of the lubricant is separated from the working fluid and returned to the lubricant sump. The lubricant is subsequently recycled through the compressor and may interact with the working fluid being drawn in the suction-pressure zone of the compressor. The elevated temperature of the lubricant raises the temperature of the working fluid in the suction-pressure zone, thereby increasing the superheat of the working fluid and reducing the volumetric efficiency of the compressor. Accordingly, it may be desirable to restrict an amount of lubricant flow through the compressor to minimize heating of the working fluid in the suction-pressure zone, while maintaining sufficient lubrication of the moving components of the compressor.

SUMMARY

This section provides a general summary of the disclosure, and is not a comprehensive disclosure of its full scope or all of its features.

In one form, the present disclosure provides a lubricant metering system that may include a cap, a cap cage, and a shaft. The cap may include an outer surface, a first recess, and a first radial bore extending between the first recess and the outer surface. The cap cage may include a second recess receiving the cap and a lubricant inlet in communication with the first recess via the first radial bore. The shaft may be received within the first recess and may include an axially extending bore and a second radial bore extending between an outer diameter of the shaft and the axially extending bore. The shaft may be mounted for rotation relative to the cap to allow lubricant to flow into the axially extending bore via the first and second radial bores when the second radial bore is aligned with the first radial bore.

In another form, the present disclosure provides a lubricant metering system for a compressor that may include a lubricant source, a first cup-shaped member, a second cup-shaped member, and a shaft. The first cup-shaped member may include a first recess in communication with the lubricant source. The second cup-shaped member may be received in the first recess and may include a second recess and a radial bore in fluid communication with the lubricant source. The shaft may be at least partially received in the second recess and may include an axially extending bore and a radially extending metering bore. The radially extending metering bore may be in fluid communication with the axially extending bore and selective fluid communication with the radial bore of the second cup-shaped member. The shaft may be mounted for rotation relative to the second cup-shaped member. The second cup-shaped member may be mounted for transverse movement relative to the first recess of the first cup-shaped member to allow axial alignment of the second recess and the shaft relative to each other.

In yet another form, the present disclosure provides a compressor that may include a shell, a compression mechanism, a drive shaft, a motor, a lubricant sump, a cap, and a cap cage. The compression mechanism is disposed within the shell. The drive shaft drivingly engages the compression mechanism and may include an axially extending bore and a first radial aperture extending between an outer diameter of the drive shaft and the axially extending bore. The motor drives the drive shaft. The lubricant sump may be fluidly coupled with the compression mechanism to receive lubricant discharged from the compression mechanism. The cap may include an outer surface, a first recess, and a second radial aperture extending between the first recess and the outer surface. The cap cage may include a second recess receiving the cap and a lubricant inlet in communication with the first recess via the second radial aperture. The drive shaft may be received within the first recess for rotation relative to the cap to allow lubricant to flow into the axially extending bore via the first and second radial apertures when the first radial aperture is aligned with the second radial aperture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
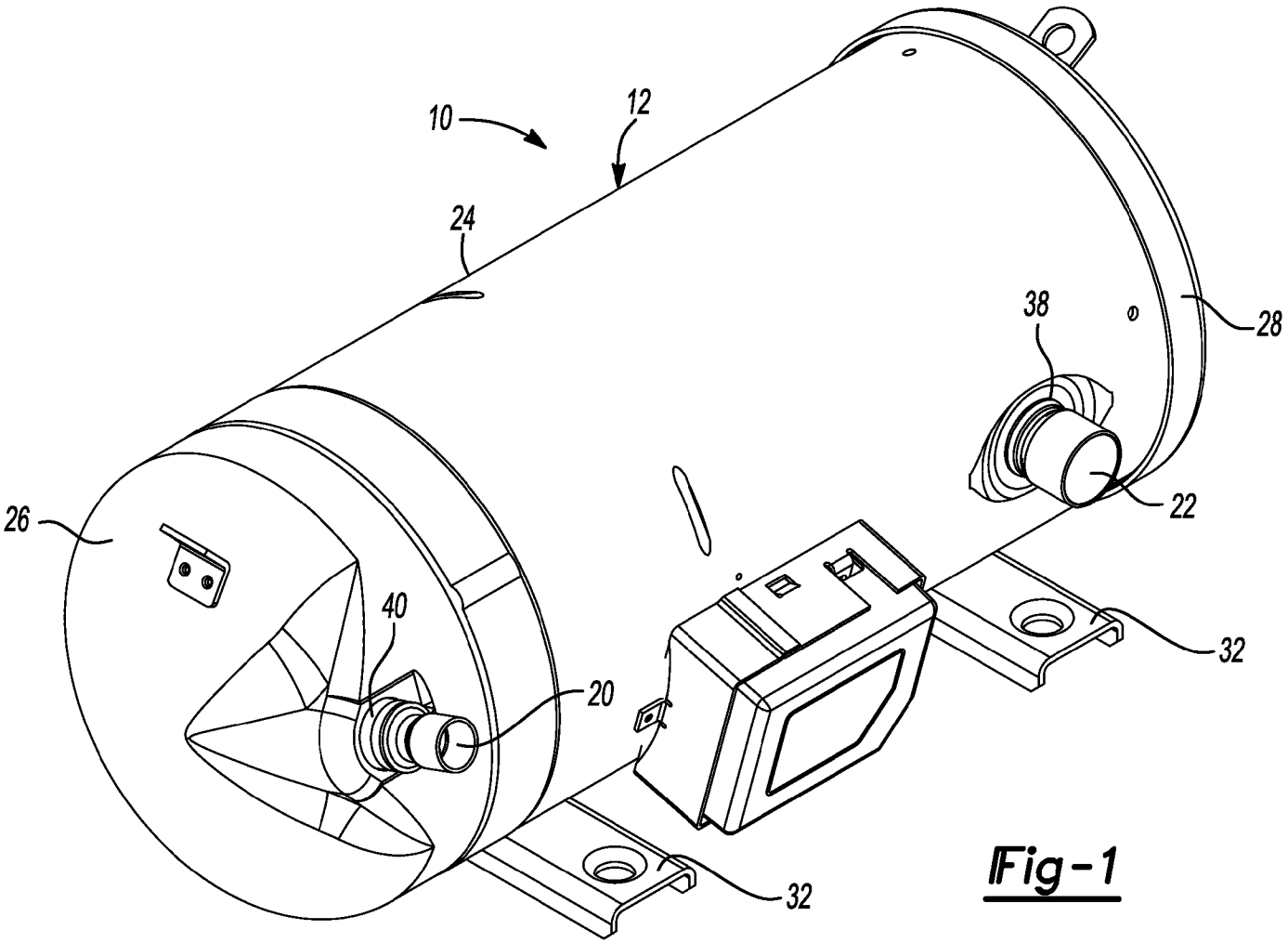
FIG. 1 is a perspective view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided and includes a shell assembly 12, a motor assembly 14, a compression mechanism 16, a lubricant metering system 18, a discharge fitting 20, and a suction gas inlet fitting 22. The compressor 10 circulates a working fluid (e.g., refrigerant) throughout a fluid circuit (not shown) of a refrigeration system, heat pump, or other climate-control system, for example. While the compressor 10 illustrated in the figures is a horizontal scroll compressor, the present teachings may be suitable for incorporation in many different types of vertical or horizontal scroll, rotary, and reciprocating compressors, for example, including hermetic machines, semi-hermetic machines, open-drive machines and non-hermetic machines.

The shell assembly 12 may house the motor assembly 14, the compression mechanism 16, and the lubricant metering system 18. The shell assembly 12 generally forms a compressor housing and may include a cylindrical shell 24, a first end cap 26, a second end cap 28, a transversely extending partition 30, and feet 32. The first end cap 26 and partition 30 may cooperate to form a discharge chamber 34 that functions as a discharge muffler for the compressor 10. A high-side lubricant sump 36 may be disposed within the discharge chamber 34 and stores a lubricant (e.g., oil) for distribution to the motor assembly 14 and compression mechanism 16. While not shown in the Figures, in some configurations, the lubricant sump 36 could be disposed outside of the shell assembly 12. In such configurations, the lubricant sump 36 may be a separate container fluidly coupled with a lubricant separator (not shown) disposed within the discharge chamber 34.

The discharge fitting 20 is attached to the shell assembly 12 at a discharge opening 40 in the first end cap 26. A discharge valve assembly (not shown) may be located within the discharge fitting 20 and may prevent a reverse-flow condition to prevent high-pressure working fluid from entering the compressor 10 via the discharge fitting 20. The suction gas inlet fitting 22 is attached to the shell assembly 12 at a suction opening 38 in the shell 24 and is in fluid communication with a suction chamber 43 disposed within the shell assembly 12. The partition 30 separates the discharge chamber 34 from the suction chamber 43 and includes a discharge passage 44 providing communication between the compression mechanism 16 and the discharge chamber 34. The discharge-valve assembly could alternatively be located at or near the discharge passage 44.

The motor assembly 14 includes a motor stator 46, a rotor 48, a drive shaft 50, and windings that pass through the stator 46. The motor stator 46 may be press fit into the shell 24 to fix the stator 46 relative to the shell 24. The drive shaft 50 is rotatably driven by the rotor 48, which may be press fit on the drive shaft 50.

The drive shaft 50 may be rotatably supported at a first end by a main-bearing housing 54 and by a second bearing 56 at a second end. The main-bearing housing 54 and the second bearing 56 are fixedly secured to the shell assembly 12. The drive shaft 50 may include an eccentric crank pin 58 having a crank pin flat 60 disposed thereon. The drive shaft 50 may also include an axially extending bore 62, radially extending metering bores 64, and radially extending lubricant delivery bores 66. The metering bores 64 may include a diameter of about three (3) millimeters, for example. While the configuration shown in FIG. 4 includes two metering bores 64 spaced approximately 180 degrees apart, the drive shaft 50 could include any number of metering bores 64 spaced apart from each other in any suitable arrangement. The metering bores 64 may be in fluid communication with the axial bore 62 and may extend between the axial bore 62 and an outer diameter of the drive shaft 50. The axial bore 62 may extend from a first end 68 of the drive shaft 50 through a portion of the length of the drive shaft 50 and may be in communication with an eccentric bore 63 extending through a second end 70 of the drive shaft 50. One of the lubricant delivery bores 66 may extend radially between the axial bore 62 and an outer surface of the drive shaft 50 and may provide lubricant to the second bearing 56. Another of the lubricant delivery bores 66 may extend radially between the eccentric bore 63 and the outer surface of the drive shaft 50 and may provide lubricant to the main-bearing housing 54.

The compression mechanism 16 may generally include an orbiting scroll 80 and a non-orbiting scroll 82. The orbiting scroll 80 includes an end plate 84 having a spiral vane or wrap 86 extending therefrom. The orbiting scroll 80 may also include a cylindrical hub 88 that projects from the end plate 84 in a direction opposite the spiral wrap 86 and engages a drive bushing 90. The drive bushing 90 may include an inner bore in which the crank pin 58 is drivingly disposed. In one configuration, the crank pin flat 60 drivingly engages a flat surface in a portion of the inner bore of the drive bushing 90 to provide a radially compliant driving arrangement.

The non-orbiting scroll 82 includes an end plate 92 having a spiral wrap 94 extending therefrom and a discharge passage 96 extending through the end plate 92. The spiral wrap 94 cooperates with the wrap 86 of the orbiting scroll 80 to create a series of moving fluid pockets when the orbiting scroll 80 is moved relative to the non-orbiting scroll 82. The pockets created by the spiral wraps 86, 94 decrease in volume as they move from a radially outer position to a radially inner position, thereby compressing the working fluid throughout a compression cycle of the compression mechanism 16.

An Oldham coupling 98 may be positioned between orbiting scroll 80 and the main-bearing housing 54 and keyed to orbiting scroll 80 and non-orbiting scroll 82. The Oldham coupling 98 may engage the orbiting scroll 80 and the non-orbiting scroll 82 to prevent relative rotation therebetween while allowing the orbiting scroll 80 to orbit relative to the non-orbiting scroll 82.

The lubricant metering system 18 may include a cap cage 100, a cap 102, a gasket 104, a sealing plate 106, and a lubricant conduit 108 fluidly coupling the lubricant metering system 18 and the lubricant sump 36. The lubricant metering system 18 may be secured to the second bearing 56 via a plurality of bolts 110.

The cap cage 100 may be a generally cup-shaped member and may include a generally cylindrical body portion 112, an end wall 114, and an annular flange portion 116 cooperating with each other to define a cylindrical recess 118. A plurality of bolt holes 120 may extend through the annular flange portion 116 and may receive the bolts 110. A slot 122 may be disposed in the annular flange portion 116 and may be in communication with the recess 118. A lubricant inlet 124 may extend between an outer diameter of the annular flange portion 116 and the recess 118.

The cap 102 may be a generally cup-shaped member and may include a generally cylindrical body portion 128, a protrusion 132, and a radial bore 134. The body portion 128 may include an outer diameter 136, an inner diameter 138, an end wall 140, and a rim 141. The inner diameter 138 and the end wall 140 may cooperate to define a generally cylindrical recess 142. The body portion 128 of the cap 102 may be received within the recess 118 of the cap cage 100. The protrusion 132 may extend from the outer diameter 136 of the cap 102 and may engage the slot 122 of the cap cage 100 to prevent relative rotation therebetween. The recess 118 of the cap cage 100 and the body portion 128 of the cap 102 may be sized relative to each other to allow the cap 102 to move axially and radially relative to the recess 118 while the cap 102 is received within the recess 118. High-pressure lubricant from the lubricant conduit 108 may occupy a spaced between the cap 102 and the cap cage 100, forming a high-pressure lubricant reservoir 143.

The radial bore 134 may extend between the outer diameter 136 of the body portion 128 and the recess 142 and may include a diameter of about two (2) millimeters, for example. The radial bore 134 may be aligned with the lubricant inlet 124 of the cap cage 100. The radial bore 134 and the lubricant inlet 124 may or may not be coaxial.

The first end 68 of the drive shaft 50 may be received within the recess 142 and may be rotatable therein relative to the cap 102. The inner diameter 138 of the cap 102 and the outer diameter of the drive shaft 50 may be sized relative to each other to minimize the friction therebetween, while preventing or minimizing lubricant leakage therebetween. When the drive shaft 50 is rotating relative to the cap 102, the metering bores 64 are moved in and out of angular alignment with the radial bore 134, thereby selectively allowing fluid communication between the axial bore 62 and the lubricant inlet 124. When none of the metering bores 64 are angularly aligned with the radial bore 134, fluid communication between the axial bore 62 and the lubricant inlet 124 may be restricted or prohibited.

The sealing plate 106 may be an annular disk including a central aperture 144 and a plurality of mounting apertures 146 engaging the bolts 110. Similarly, the gasket 104 may be an annular disk including a central aperture 148 and a plurality of mounting apertures 150 engaging the bolts 110. The gasket 104 may be formed from a compliant polymeric or metallic material, while the sealing plate 106 may be formed from a relatively rigid polymeric or metallic material. The drive shaft 50 may extend through the central apertures 144 and 148 of the sealing plate 106 and gasket 104, respectively. A first side of the sealing plate 106 may abut a flange 152 of the second bearing 56. A second side of the sealing plate 106 may abut a first side of the gasket 104. In some configurations, the gasket 104 and/or the sealing plate 106 may be integrally formed with the second bearing 56. The second side of the gasket 104 may sealingly abut the cap cage 100 and the cap 102. The relatively high-pressure of the lubricant disposed within the high-pressure lubricant reservoir 143 may urge the rim 141 of the cap 102 into sealing engagement with the gasket 104. In this manner, the gasket 104 and the sealing plate 106 cooperate to prevent fluid communication between the lubricant reservoir 143 and the recess 142 via any path other than through the radial bore 134. Furthermore, the sealed relationship between the cap cage 100 and the gasket 104 prevents lubricant from leaking therebetween into the suction chamber 43.

The lubricant conduit 108 provides fluid communication between the lubricant sump 36 and the recess 118 of the cap cage 100. A fitting 154 may engage the lubricant inlet 124 and the lubricant conduit 108 and provide fluid communication therebetween. The lubricant conduit 108 may be routed within the shell assembly 12, as shown in FIG. 2, or, alternatively, the lubricant conduit 108 could be routed externally from the shell assembly 12.

With continued reference to FIGS. 1-4, operation of the compressor 10 will be described in detail. Energizing the motor assembly 14 causes the drive shaft 50 to rotate, which in turn operates the compression mechanism 16. As described above, the compression mechanism 16 circulates the working fluid through the refrigeration system or heat-pump system. During operation of the compressor 10, relatively low-pressure working fluid is drawn into the suction chamber 43 via the suction gas inlet fitting 22. From the suction chamber 43, the low-pressure working fluid is drawn into the compression mechanism 16 and is compressed to a relatively high discharge-pressure. The working fluid is then discharged from the compression mechanism 16 through the discharge passage 44 and into the discharge chamber 34. Lubricant in the compression mechanism 16 may be mixed in with the working fluid and discharged therewith into the discharge chamber 34. A lubricant separator 156 (FIG. 2) disposed within the discharge chamber 34 filters or separates some or all of the lubricant from the working fluid. Once separated from the working fluid, the lubricant may fall from the lubricant separator, via gravity, into the lubricant sump 36. In some configurations, the lubricant separator 156 may be disposed outside of the shell assembly 12 and provide lubricant to an external lubricant sump (not shown) disposed outside of the shell assembly 12.

Figure 2:
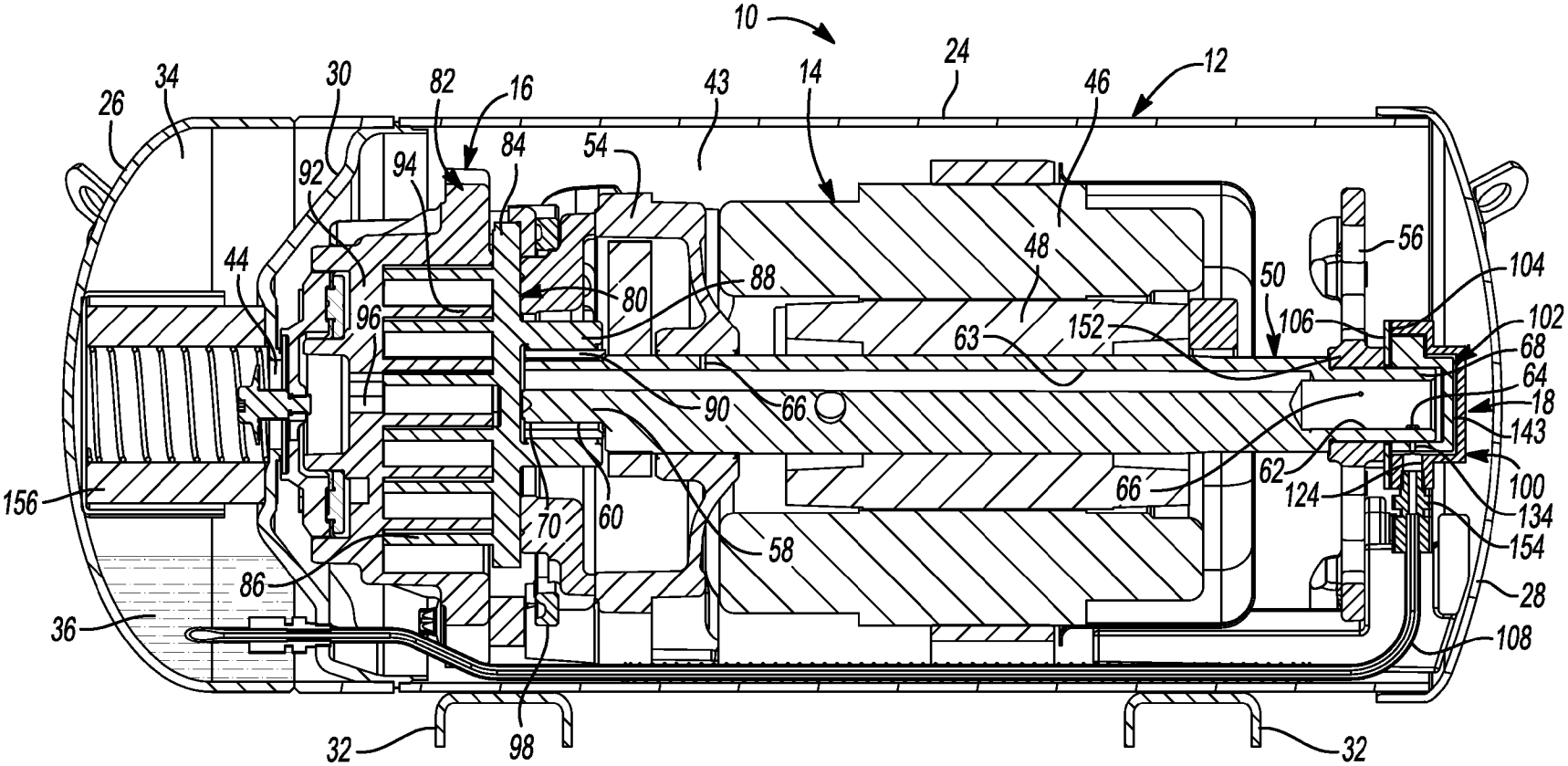
FIG. 2 is a cross-sectional view of the compressor of FIG. 1.
Figure 3:
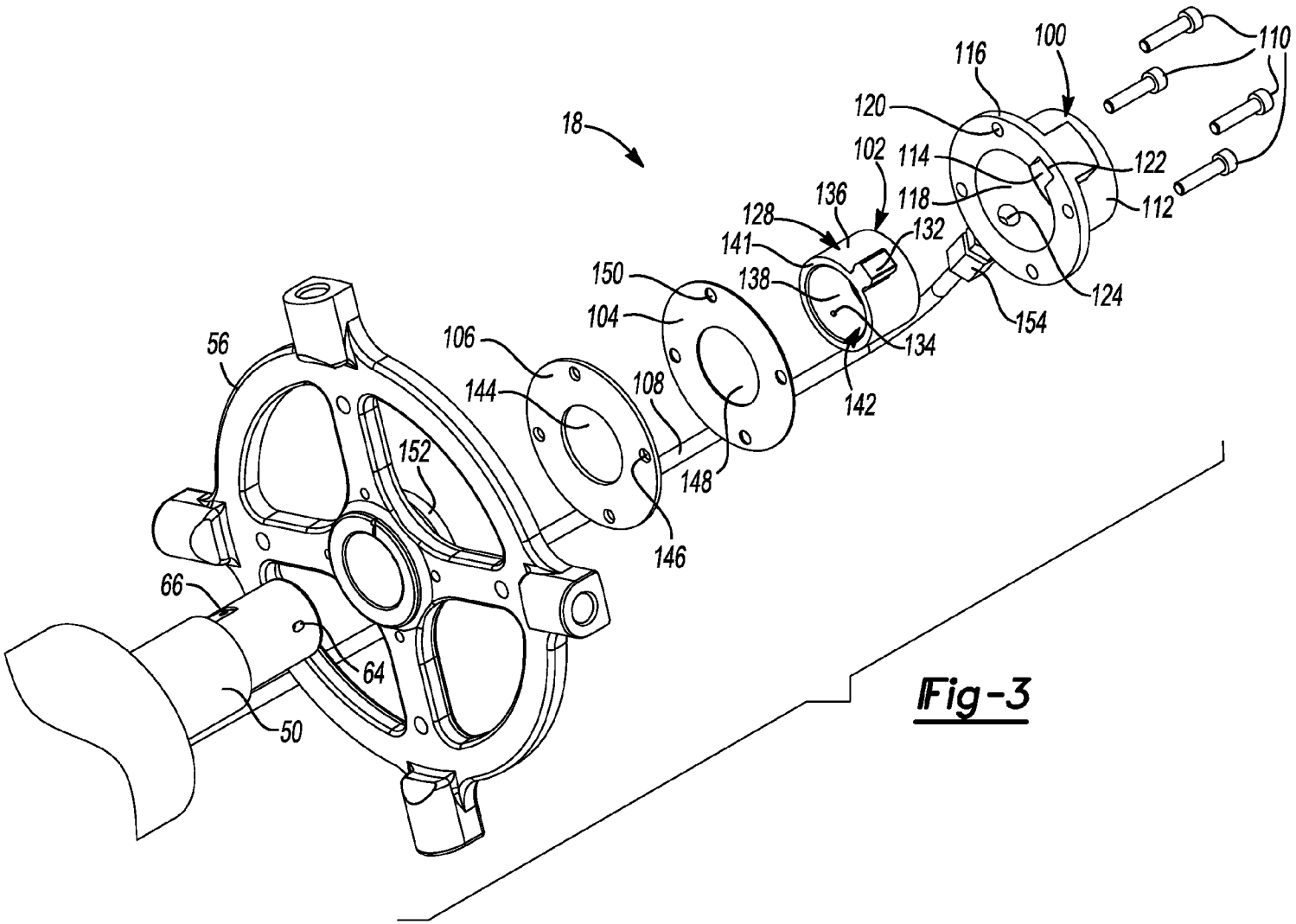
FIG. 3 is an exploded perspective view of a lubricant metering system according to the principles of the present disclosure.
Figure 4:
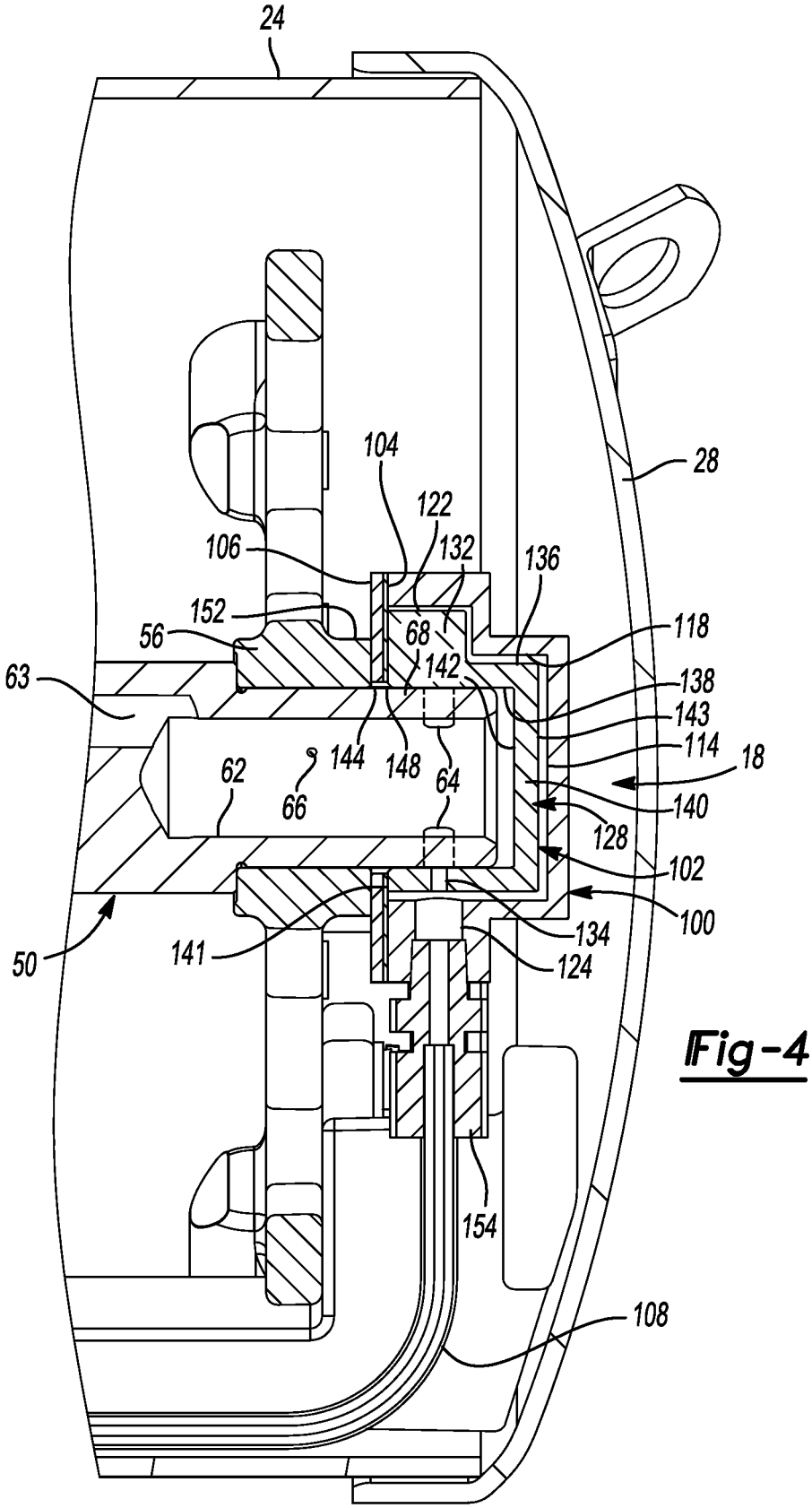
FIG. 4 is a cross-sectional view of the metering system of FIG. 3.

As shown in FIG. 2, the lubricant inlet 124 of the cap cage 100 is in fluid communication with the suction chamber 43 via the radial bore 134, the metering bores 64, the axial bore 62, the eccentric bore 63, and the lubricant delivery bores 66. Therefore, the pressure differential between the high-side lubricant sump 36 and the suction chamber 43 causes the high-pressure lubricant stored in the lubricant sump 36 to flow through the lubricant conduit 108 toward the cap cage 100 of the lubricant metering system 18. From the lubricant conduit 108, the lubricant flows through the fitting 154 and into the lubricant inlet 124 and into the high-pressure lubricant reservoir 143 disposed between the cap cage 100 and the cap 102. The relatively high-pressure lubricant disposed within the high-pressure lubricant reservoir 143 may urge the cap 102 in an axial direction such that the rim 141 of the cap 102 engages the gasket 104.

As described above, the clearance between the outer diameter 136 of the of the cap 102 and the inner diameter of the recess 118 of the cap cage 100 allows the cap 102 to "float" or move in a radial direction relative to the cap cage 100. In this manner, the cap 102 may be movable to "self-align" the axis of rotational symmetry of the recess 142 of the cap 102 with the rotational axis of the drive shaft 50. This self-aligning feature provides a more robust seal between the inner diameter 138 of the cap 102 and the outer diameter of the drive shaft 50. Because the drive shaft 50 is axially centered within the recess 142 of the cap 102, clearance between the inner diameter 138 of the cap 102 and the outer diameter of the drive shaft 50 may be minimized, thereby minimizing lubricant leakage therebetween. Minimized lubricant leakage between the inner diameter 138 of the cap 102 and the outer diameter of the drive shaft 50 due to the self-alignment of the recess 142 and the drive shaft 50 ensures that lubricant is delivered to desirable locations, such as the main bearing housing 54 and the second bearing 56, for example. Furthermore, localized friction between the outer diameter of the drive shaft 50 and the recess 142 due to rotational misalignment may be minimized or eliminated, thereby minimizing or eliminating localized wear and improving the longevity and efficiency of these components.

Using the fluid pressure of the lubricant within the high-pressure lubricant reservoir 143 to bias the rim 141 of the cap 102 against the gasket 104, as described above, ensures axial alignment of the metering bores 64 and the radial bore 134 and allows the radial movement of the cap 102 relative to the cap cage 100. In contrast, if the rim 141 were biased against the gasket 104 via a bolt or other fastener, the retaining force that the bolt or other fastener would be required to exert on the cap 102 to seal the rim 141 against the gasket 104 would prevent or restrict the radial self-alignment of the cap 102 relative to the drive shaft 50.

As described above, the axial bore 62 is in fluid communication with the lubricant inlet 124 via the radial bore 134 of the cap 102 and the metering bores 64 of the drive shaft 50. Since the cap 102 is rotationally fixed relative to the cap cage 100, and the drive shaft 50 is rotatable relative to the cap 102, each of the metering bores 64 are only selectively communicating with the radial bore 134. That is, the radial bore 134 may be in communication with one or more of the metering bores 64 when the one or more metering bores 64 are angularly aligned with the radial bore 134. Accordingly, the lubricant flow rate into the axial bore 62 is dependent upon the number of metering bores 64 and the diameters of the metering bores 64 and the radial bore 134.

In the particular configuration shown in the figures, the metering bores 64 are angularly spaced 180 degrees apart from each other. Therefore, while the compressor 10 is operating at a constant speed, lubricant flows into the axial bore 62 from the radial bore 134 twice, in equal increments, for every complete revolution of the drive shaft 50. In other configurations, the number of metering bores 64, the spacing therebetween, and/or the diameters of the metering bores 64 and/or radial bore 134 may differ from the configuration described above to achieve a desired lubricant flow rate. In some configurations, the metering bores 64 may be elongated in a direction parallel to the rotational axis of the drive shaft 50 to provide more tolerance with respect to the axial alignment of the metering bores 64 and the radial bore 134.

Once the lubricant reaches the axial bore 62, a first portion of the lubricant may flow through the lubricant delivery bore 66 disposed therein to lubricate the second bearing 56. Centrifugal force causes a second portion of the lubricant to enter the eccentric bore 63, through which the lubricant may flow along the length of the drive shaft 50. Lubricant may exit the eccentric bore 63 at the second end 70 of the drive shaft 50 and/or any remaining lubricant delivery bores 66 disposed in the eccentric bore 63 to be distributed to various components of the compressor 10 such as the rotor 48, the main-bearing housing 54, and/or compression mechanism 16, for example. As described above, lubricant may mix with the working fluid that is drawn into the compression mechanism 16 and is discharged therefrom at a relatively high pressure into the discharge chamber 34 and returned to the lubricant sump 36. In this manner, the lubricant may be cycled between the lubricant sump 36 and the lubricant metering system 18.

Figure 5:
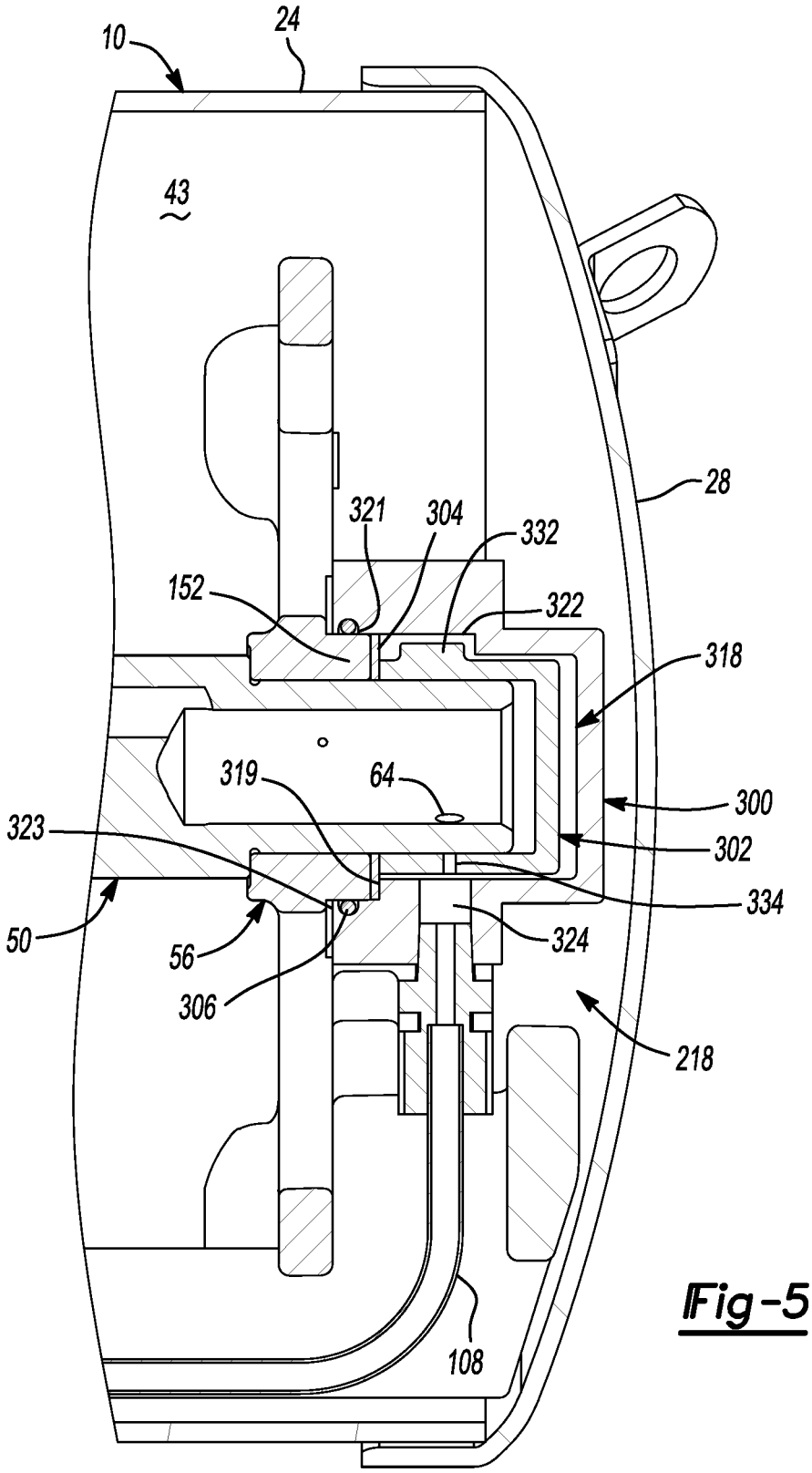
FIG. 5 is a cross-sectional view of another metering system according to the principles of the present disclosure.

With reference to FIG. 5, another lubricant metering system 218 is provided. The structure and function of the lubricant metering system 218 may be generally similar to the structure and function of the lubricant metering system 18 described above, apart from the exceptions noted below. The lubricant metering system 218 may include a cap cage 300, a cap 302, a wear plate 304, a sealing member 306, and the lubricant conduit 108. The lubricant metering system 218 may be bolted, press-fit and/or otherwise secured to the second bearing 56.

The cap cage 300 may include a recess 318, a slot 322, and a lubricant inlet 324. The recess 318 may include an annular step 319 and an annular groove 321 disposed between the annular step 319 and an open end 323 of the recess 318. The lubricant inlet 324 may be in fluid communication with the lubricant conduit 108 to provide fluid communication between the lubricant sump 36 and the recess 318, as described above. The cap 302 may be received within the recess 318 and may include a protrusion 332 engaging the slot 322, as described above. The flange 152 of the second bearing 56 may be at least partially received in the recess 318.

The wear plate 304 may be an annular disk-shaped member and may be received in the recess 318 and engage the annular step 319. The wear plate 304 may abut the cap 302 and the flange 152 of the second bearing 56. High-pressure lubricant between the cap cage 300 and the cap 302 biases the cap 302 against the wear plate 304. As described above, biasing the cap 302 against the wear plate 304 in this manner ensures axial alignment of the metering bores 64 in the drive shaft 50 with a radial bore 334 in the cap 302 and allows radial movement of the cap 302 relative to the cap cage 300.

The sealing member 306 may be an O-ring or other annular seal, for example, and may be received in the annular groove 321 in the recess 318. The sealing member 306 may sealingly engage the recess 318 and the flange 152 of the second bearing 56 to prevent lubricant from leaking out of the recess 318 into the suction chamber 43 of the compressor 10.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A lubricant metering system for a compressor comprising:

a cap including an outer surface, a first recess, and a first radial bore extending between said first recess and said outer surface;

a cap cage including a second recess receiving said cap and a lubricant inlet in communication with said first recess via said first radial bore; and a shaft received within said first recess and including an axially extending bore and a second radial bore extending between an outer diameter of said shaft and said axially extending bore, said shaft is mounted for rotation relative to said cap to allow lubricant to flow into said axially extending bore via said first and second radial bores when said second radial bore is aligned with said first radial bore, wherein a high-pressure lubricant reservoir disposed between said cap cage and said cap axially biases said cap.

2. The lubricant metering system of claim 1, wherein said high-pressure lubricant reservoir disposed between said cap cage and said cap axially biases said cap against an annular member.

3. The lubricant metering system of claim 2, wherein said annular member is disposed between said cap and a bearing rotatably supporting said shaft, said annular member including at least one of a wear plate, a sealing plate, and a gasket.

4. The lubricant metering system of claim 3, wherein said cap cage sealingly engages said annular member.

5. The lubricant metering system of claim 3, wherein said cap cage is fixed relative to said bearing.

6. The lubricant metering system of claim 1, wherein said high-pressure lubricant reservoir extends between an inner surface of said cap cage and an outer surface of said cap and provides clearance between said cap and said cap cage to allow said cap to move in a radial direction relative to said cap cage.

7. The lubricant metering system of claim 1, further comprising an annular sealing member disposed in an annular groove in said inner surface of said cap cage, said annular sealing member sealingly engaging a bearing member rotatably supporting said shaft.

8. The lubricant metering system of claim 1, wherein a lubricant injection line is fluidly coupled to said lubricant inlet and provides fluid communication between a lubricant source and said lubricant reservoir.

9. The lubricant metering system of claim 1, further comprising a plurality of radial bores in said shaft that are selectively aligned with said first radial bore.

10. The lubricant metering system of claim 1, wherein said cap includes a protrusion and said cap cage includes a slot receiving said protrusion to prevent relative rotational movement between said cap and said cap cage.

11. The lubricant metering system of claim 10, wherein said protrusion and said slot are sized relative to each other to allow relative radial and axial movement between said cap and said cap cage.

12. The lubricant metering system of claim 1, wherein said first radial bore includes a diameter of about two millimeters.

13. The lubricant metering system of claim 1, wherein said second radial bore includes a diameter of about three millimeters.

14. A compressor comprising:

a shell;

a compression mechanism disposed within said shell;

a drive shaft drivingly engaging said compression mechanism and including an axially extending bore and a first radial aperture extending between an outer diameter of said drive shaft and said axially extending bore;

a motor driving said drive shaft;

a lubricant sump fluidly coupled with said compression mechanism to receive lubricant discharged from said compression mechanism;

a cap including an outer surface, a first recess, and a second radial aperture extending between said first recess and said outer surface; and a cap cage including a second recess receiving said cap and a lubricant inlet in communication with said first recess via said second radial aperture, wherein said drive shaft is received within said first recess for rotation relative to said cap to allow lubricant to flow into said axially extending bore via said first and second radial apertures when said first radial aperture is aligned with said second radial aperture, wherein a high-pressure lubricant reservoir disposed between said cap cage and said cap axially biases said cap into sealing engagement with an annular member.

15. The compressor of claim 14, wherein said high-pressure lubricant reservoir extends between an inner diameter of said cap cage and an outer diameter of said cap and provides clearance between said inner diameter of said cap cage and said outer diameter of said cap to allow said cap to move in a radial direction relative to said cap cage.

16. The compressor of claim 14, wherein a lubricant injection line is fluidly coupled to said lubricant inlet and provides fluid communication between said lubricant reservoir and said lubricant sump.

17. The compressor of claim 14, further comprising a plurality of radial apertures in said drive shaft selectively aligned with said second radial aperture.

18. The compressor of claim 14, wherein said annular member includes a sealing plate and a gasket.

19. The compressor of claim 14, wherein said annular member is disposed between said cap and a bearing rotatably supporting said drive shaft.

20. The compressor of claim 19, wherein said annular member includes an annular sealing member disposed in an annular groove in said cap cage, said annular sealing member sealingly engaging said bearing.

21. The compressor of claim 19, wherein said cap cage is fixed relative to said bearing.

22. The compressor of claim 14, wherein said cap includes a protrusion and said cap cage includes a slot receiving said protrusion to prevent relative rotational movement between said cap and said cap cage.

23. The compressor of claim 22, wherein said protrusion and said slot are sized relative to each other to allow relative radial and axial movement between said cap and said cap cage.

24. The compressor of claim 14, wherein said shell and said drive shaft are arranged horizontally.

25. The compressor of claim 14, wherein said compression mechanism includes a first scroll member orbiting relative to a second scroll member, said first and second scroll members having intermeshed spiral wraps defining at least one moving fluid pocket.

26. The compressor of claim 14, wherein said first radial aperture includes a diameter of about three millimeters and said second radial aperture includes a diameter of about two millimeters.

27. The compressor of claim 14, wherein said drive shaft includes at least one lubricant delivery aperture axially spaced apart from said first radial aperture.

28. The compressor of claim 14, further comprising a partition disposed within said shell and cooperating with said shell to define a suction pressure zone and a discharge pressure zone, said lubricant sump being disposed in said discharge pressure zone.

* * * * *

UNITED STATES PATENT AND TRADEMARK OFFICE

CERTIFICATE OF CORRECTION

PATENT NO. : 8,506,272 B2
APPLICATION NO. : 12/891157
DATED : August 13, 2013
INVENTOR(S) : Shuichong Fan et al.

It is certified that error appears in the above-identified patent and that said Letters Patent is hereby corrected as shown below:

Title Page

| | |
|---|---|
| (30) Foreign Application Priority Data should read | Sep. 6, 2010 (CN) ..... 201020517978.2 |
| | Sep. 6, 2010 (CN) ..... 201010273028.4 |

In the Specification

| | |
|---|---|
| Column 7, Detailed Description, Line 48 | After “136”, delete “of the”. |
| Column 7, Detailed Description, Line 50 | Delete “move” and insert --“move”--. |

Signed and Sealed this
Second Day of December, 2014

Michelle K. Lee

Michelle K. Lee
*Deputy Director of the United States Patent and Trademark Office*